US007114320B2

(12) United States Patent
Niwa et al.

(10) Patent No.: US 7,114,320 B2
(45) Date of Patent: Oct. 3, 2006

(54) COMPOSITE ELASTIC YARN AND MANUFACTURING METHOD THEREOF, STRETCHABLE TEXTILE FABRIC, AND STRETCHABLE KNITTED FABRIC

(75) Inventors: Yuki Niwa, Okazaki (JP); Shu Ono, Okazaki (JP); Shigeo Horikoshi, Okazaki (JP)

(73) Assignee: Nisshinbo Industries Inc., Tokyo (JP)

( * ) Notice: Subject to any disclaimer, the term of this patent is extended or adjusted under 35 U.S.C. 154(b) by 0 days.

(21) Appl. No.: 10/330,735

(22) Filed: Dec. 27, 2002

(65) Prior Publication Data

US 2003/0121245 A1 Jul. 3, 2003

(30) Foreign Application Priority Data

Dec. 27, 2001 (JP) ..... 2001-398567

(51) Int. Cl.
*D02G 3/02* (2006.01)

(52) U.S. Cl. ..... 57/225

(58) Field of Classification Search ..... 57/3, 57/6, 13, 15–18, 210, 225, 226, 230, 244
See application file for complete search history.

(56) References Cited

U.S. PATENT DOCUMENTS 1,013,071 A 12/1911 Monsanto
4,226,076 A 10/1980 Griset
4,470,250 A * 9/1984 Arenz et al. ..... 57/225
5,008,992 A 4/1991 Gehrmann et al.
5,237,805 A * 8/1993 Menegatto ..... 57/16
5,442,815 A * 8/1995 Cordova et al. ..... 2/161.7
5,517,832 A * 5/1996 Kristensen ..... 66/177
5,823,014 A * 10/1998 Kobayashi et al. ..... 66/178 R
6,015,618 A * 1/2000 Orima ..... 428/373
6,101,801 A * 8/2000 Boni ..... 57/18

FOREIGN PATENT DOCUMENTS

FR 2-617-2 12/1988
JP 05-0441 2/1993
JP 05272019 A * 10/1993

* cited by examiner

*Primary Examiner*—Shaun R Hurley
(74) *Attorney, Agent, or Firm*—Apex Juris pllc; Tracy M. Heims

(57) ABSTRACT

The composite elastic yarn may be made from a wide, stretchable textile fabric or stretchable knitted fabric. A composite elastic yarn is obtained by drawing an elastic yarn 11 at a first draft rate to prepare a precursor composite elastic yarn with an inelastic yarn 31 and further drawing the precursor composite elastic yarn at a second draft rate of a value smaller than that of the first draft rate to make a composite with the removable inelastic yarn 31; and stretchable textile fabric and stretchable knitted fabric fabricated using this composite elastic yarn.

2 Claims, 2 Drawing Sheets

COMPOSITE ELASTIC YARN AND MANUFACTURING METHOD THEREOF, STRETCHABLE TEXTILE FABRIC, AND STRETCHABLE KNITTED FABRIC

BACKGROUND OF THE INVENTION

1. Field of the Invention

The present invention relates to a composite elastic yarn, stretchable textile fabric and stretchable knitted fabric using the same.

2. Description of Related Art

Conventionally, regarding a stretchable textile fabric or a stretchable knitted fabric using polyurethane elastic composite yarn, its maximum extension width is restricted by a reed space of a weaving machine or a shuttle diameter of a knitting machine, so that special equipment is required in order to obtain a wider cloth-like structure.

For example, in the case where a general weaving machine with a reed space of 190 cm is used, a finishing width of 127 cm is produced whereby the finished textile fabric has a stretch rate of 30% to 40%. It has been difficult to obtain a cloth-like structure with a double width (150 cm). In order to obtain a cloth-like structure with a double width, a special wide weaving machine with a reed space of 220 cm has been required. This double width is extremely advantageous and a high market need exists for such a product.

OBJECT AND SUMMARY OF THE INVENTION

The present invention provides a composite elastic yarn from which a wide, stretchable, textile fabric or a wide, stretchable, knitted fabric can be obtained.

Also, the present invention provides a wide stretchable textile fabric and a wide stretchable knitted fabric.

The present invention is a composite elastic yarn obtained by drawing an elastic yarn at a first draft rate to prepare a precursor composite elastic yarn composed with an inelastic yarn; and further drawing the precursor composite elastic yarn at a second draft rate of a value smaller than that of the first draft rate to make a composite with a removable inelastic yarn; or a manufacturing method for fabricating a composite elastic yarn, comprising: an elastic yarn drawn at a first draft rate to make a composite with an inelastic yarn; and further drawing the composed elastic yarn at a second draft rate of a value smaller than that of the first draft rate to make a composite with a removable inelastic yarn; or a stretchable textile fabric obtained by fabricating a textile fabric using a composite elastic yarn obtained by drawing an elastic yarn at a first draft rate to prepare a precursor composite elastic yarn composed with an inelastic yarn, and further drawing the precursor composite elastic yarn at a second draft rate of a value smaller than that of the first draft rate to make a composite with a removable inelastic yarn; and removing the removable inelastic yarn from the textile fabric; or a stretchable knitted fabric obtained by fabricating a knitted fabric using a composite elastic yarn obtained by drawing an elastic yarn at a first draft rate to prepare a precursor composite elastic yarn composed with an inelastic yarn, and further drawing the precursor composite elastic yarn at a second draft rate of a value smaller than that of the first draft rate to make a composite with a removable inelastic yarn; and removing the removable inelastic yarn from the knitted fabric.

BRIEF DESCRIPTION OF THE DRAWINGS

The above and other objects and the attendant advantages of the present invention will become readily apparent by reference to the following detailed description when considered in conjunction with the accompanying drawings.

PREFERRED EMBODIMENTS OF THE INVENTION

An embodiment of the invention is explained below with reference to the attached drawings.

A composite elastic yarn is one obtained by drawing an elastic yarn at a predetermined draft rate to make a composite with an inelastic yarn. The composite elastic yarn of the present invention is a doubly composed one, and it is first obtained by drawing an elastic yarn at a predetermined draft rate to fabricate a precursor composite elastic yarn at a draft rate of a value smaller than the predetermined draft rate to make a composite with a removable inelastic yarn.

Here, as the elastic yarn, there are polyurethane elastic yarn and the like; as the inelastic yarn, there are natural fibers such as cotton, regenerated fibers such as rayon and the like, refined cellulose fibers such as TENSEL® and the like, a staple span yarn such as synthetic fibers represented by polyester, polyamide, polyacrylonitrile, or filaments; and as the removable inelastic fibers there are PVA (polyvinyl alcohol) filaments. Also, as the composing means, there is covering, overfeed twisting, interface according to air entangling, double driving and the like.

Figure 1:
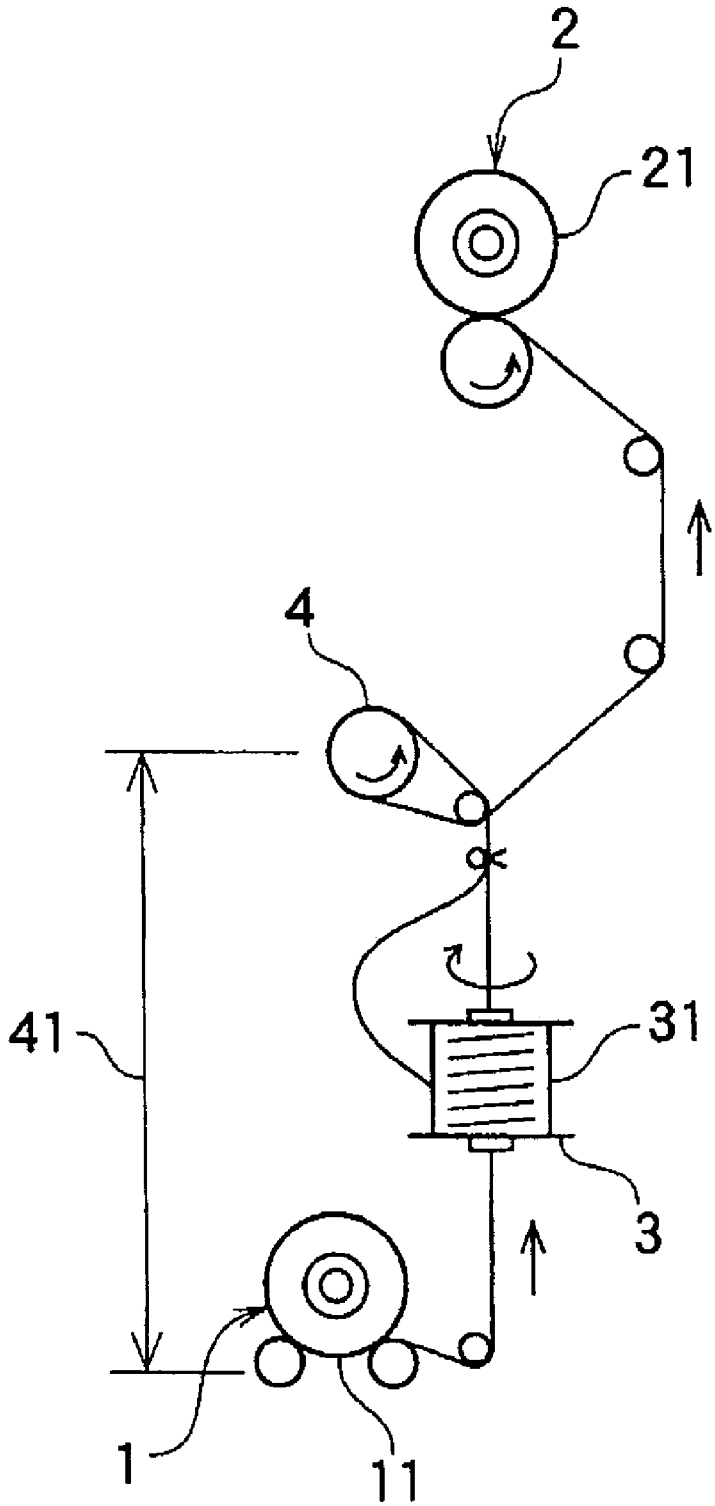
FIG. 1 is an explanatory diagram of a covering machine.
Figure 2:
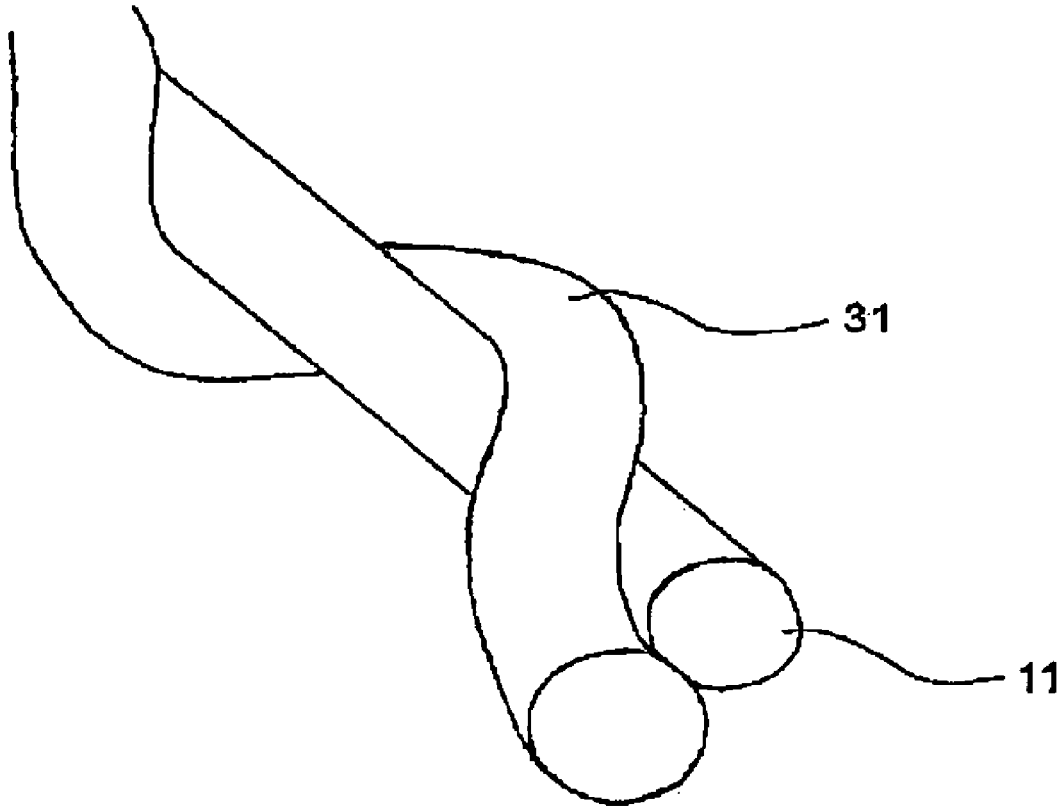
FIG. 2 is a schematic view of a composite elastic yarn of this invention.

In a process for conducting covering, for example, a covering machine shown in FIG. 1 can be used. First, an elastic yarn 11 supplied from a first cheese 1 is caused to pass through a covering yarn bobbin 3. That is, the elastic yarn 11 is caused to pass through the covering yarn bobbin 3 on which an inelastic yarn 31 has been wound so as to surround the elastic yarn 11. A draft zone 41 is formed between the first cheese 1 and an intermediate roller 4, so that the elastic yarn 11 is drawn at a predetermined draft rate. The covering yarn bobbin 3 is rotated while the elastic yarn 11 is being wound on a second cheese 2 so that the inelastic yarn 31 conducts a covering around a periphery of the drafted elastic yarn 11, thereby forming a covering yarn 21. By repeating such a covering plural times, a plurality of the covering can be conducted. That is, when the covering is conducted one time, a single covering yarn can be manufactured, and when the covering is conducted two times, a double covering yarn can be for conducting one covering one time, but an apparatus where a plurality of drafting zones 41 are provided such that a plurality of coverings can be simultaneously conducted may be used instead thereof.

Embodiment of the present invention will be explained below with reference to the drawing.

In manufacturing a composite elastic yarn of the present invention, a polyurethane elastic yarn **30*d* is used as the elastic yarn, a woolly Tetron 57*d* is used as the inelastic yarn, and 24 pieces of a PVA filament 70*d*** is used as the removable inelastic yarn. First, under the condition where the polyurethane elastic yarn is drawn to the draft rate of 3.5 times using a covering machine, the woolly Tetron is wound on drawn polyurethane elastic yarn in an S direction or in a Z direction with a count of twist of 500T/M to fabricate a single covering yarn which is a precursor composite elastic yarn.

Next, under the condition where the single covering yarn is further drawn to the draft rate of 2.6 times (is overfed by 33%) similarly using the covering machine, the PVA filament is wound on the drawn single covering yarn in a direction opposed to the single covering (in the Z direction or in the S direction) with a twist count of 500T/M to fabricate a double covering yarn which is the composite elastic yarn. By changing the drafting rates of the first covering and the second covering, the extension rate can be changed.

In fabricating a stretchable textile fabric using the composite elastic yarn of the present invention, a two ply yarn of 60 yarn count of 100% cotton is used as a warp yarn while the double covering yarn as fabricated in the above manner is used as a weft yarn. A stretchable textile fabric is fabricated by a plain weaving with a warp yarn density of 94 pieces/sun and a weft yarn density of 60 pieces/sun. The reed space is 190 cm. Thereafter, the fabric is relaxed and the PVA filament is dissolved and is thereby completely removed. Data about this plain weave fabric is shown in Table 1.

As a comparative embodiment, a polyurethane elastic yarn 30*d* is used as the elastic yarn and a woolie nylon 40*d* is used as the inelastic yarn. First, in a state where the polyurethane elastic yarn is drawn to the draft rate of 3.5 times, the woolie nylon is wound on the drawn polyurethane elastic yarn in the Z direction with the twisting number of 900 T/M to fabricate a single covering yarn. A plain weave fabric is fabricated using the single covering yarn as a weft yarn like the above example. As such, the fabric is fabricated by a plain weaving wherein a two-ply-yarn of 60 yarn number count of 100% cotton is used for the warp yarn with the warp yarn density of 94 pieces/sun, while the above-described single covering yarn is used for the weft yarn with the weft yarn density of 60 pieces/sun. The reed space is 190 cm. Thereafter, the fabric is relaxed/dyed and is subjected to a finishing treatment. Data about the plain weave fabric of this comparative example is also shown in Table 1. Units in Table 1 are "cm," except for the extension percentages.

TABLE 1

| Sample | Reed space | Gray fabric width | Maximum extension after dying | Finishing width | Extension percentage |
|---|---|---|---|---|---|
| Example | 190 | 170 | 201 | 155 | 30% |
| Comparative Example | 190 | 130 | 174 | 134 | 30% |

In the dying treatment shown in Table 1, a relaxing treatment (treating the fabric with hot water to stabilize the shape of the fabric) is first conducted, a bleaching treatment is conducted, a dying treatment with disperse dye is conducted, a soaping treatment is conducted and a setting is conducted. Also, the width of the dyed fabric can be adjusted by changing the weft yarn density of the fabric.

In the case where a stretchable fabric having about an extension percentage of approximately 30% is fabricated using a weaving machine with a reed space of 190 cm, the gray fabric width is 170 cm in the embodiment. However, it is 130 cm in the comparative embodiment. When these fabrics are subjected to a dying treatment, after the removable inelastic yarn of the embodiment is removed, relaxed/dyed and finishing-treated, a finishing width of 155 cm is obtained. However, it is 134 cm in the comparative embodiment, so that a remarkably wide textile fabric could be fabricated in the case of the embodiment. The stretchable textile fabric as described in the above embodiment thus obtained can be used for working wear or the like.

The present invention provides the following advantages.

The present invention can fabricate a composite elastic yarn from which a wide textile fabric or knitted fabric can be obtained.

Also, the present invention can fabricate a wide, stretchable, textile fabric or stretchable knitted fabric.

It is readily apparent that the above-described invention is advantageous for use in wide commercial utility. It should be understood that the specific form of the invention hereinabove is intended to be representative only, and certain modifications within the scope of these teachings will be apparent to those skilled in the art without departing from the spirit and scope of the invention.

Accordingly, reference should be made to the following claims in determining the full scope of the invention.

The invention claimed is:

1. A method of manufacturing a stretchable textile fabric using a composite elastic yarn comprising steps of:

drawing an elastic yarn at a first draft rate to prepare a precursor composite elastic yarn composed with an inelastic yarn;

drawing said precursor composite elastic yarn at a second draft rate of a value smaller than that of the first draft rate to conduct composing with a removable inelastic yarn; and removing the removable inelastic yarn.

2. A stretchable textile fabric using a composite elastic yarn produced according to the method of claim 1.

* * * * *